US005087941A

United States Patent [19]

Smith

[11] Patent Number: 5,087,941

[45] Date of Patent: Feb. 11, 1992

[54] XEROGRAPHIC REPRODUCING MACHINE FOR CONTROLLED COPYING OF MANUALLY DISPOSED DOCUMENTS

[75] Inventor: Craig A. Smith, Pittsford, N.Y.

[73] Assignee: Xerox Corporation, Stamford, Conn.

[21] Appl. No.: 635,838

[22] Filed: Jan. 3, 1991

[51] Int. Cl.[5] ..... G03G 21/00

[52] U.S. Cl. ..... 355/204; 355/208; 355/313

[58] Field of Search ..... 355/200, 204, 208, 25, 355/313, 314

[56] References Cited

U.S. PATENT DOCUMENTS 4,618,245 10/1986 Fukushi et al. ..... 355/313 X 5,041,718 8/1991 d'Hondt et al. ..... 355/208 X

*Primary Examiner*—A. T. Grimley

*Assistant Examiner*—Patrick J. Stanzicne

*Attorney, Agent, or Firm*—Finnegan, Henderson, Farabow, Garrett & Dunner

[57] ABSTRACT

A xerographic reproducing machine including a manually operable start switch, a circuit responsive to actuation of the start switch for cycling from a standby condition to an operating condition for performing a process for copying a document, the copying process including machine preparation to a copy ready state and subsequent initiation of the sequential copying steps, a timing circuit for initiating the copying steps after achieving the copy ready state, and a standby circuit for cycling the machine to the standby condition after a predetermined time absent re-actuation of the start switch, the improvement comprising a delay control circuit connected to said timing circuit for delaying initiation of the copying steps after achieving the copy ready state, a switch for selectively activating the delay control switch, and a circuit responsive to activation of the delay control switch for bypassing the standby circuit.

22 Claims, 8 Drawing Sheets

XEROGRAPHIC REPRODUCING MACHINE FOR CONTROLLED COPYING OF MANUALLY DISPOSED DOCUMENTS

BACKGROUND OF THE INVENTION

1. Field of the Invention

The invention relates to an apparatus and method for sequentially xerographically copying a plurality of manually manipulated documents and, in particular, relates to an apparatus and method for facilitating the copying of pages in a book by controlling operation of a xerographic machine to allow manual disposition of sequential pages while the machine remains in an operating condition.

2. Description of Related Art

In known xerographic copying machines, the process copying an original document disposed for copying involves electrostatically charging a photoconductive surface and moving the charged surface to a position where it is exposed to a light image of the original document for selectively dissipating the charge to form a latent electrostatic image of the original on the surface. The surface bearing the latent image is then moved to a developing station at which a developer mix or toner is applied to the surface rendering the latent image visible. The surface bearing the now-visible image thereafter is moved to a transfer station for contact with a sheet of support material, usually paper, which simultaneously has been fed from a supply to the transfer station. The sheet of support material to which the image has been transferred is then moved to a fusing station at which the image is fixed and thereafter is fed to an output stacker.

After the transfer station, the photoconductive surface is moved to a cleaning station at which toner is removed and the surface is electrically neutralized in preparation for a subsequent copying process.

The light image of the original document is generated by various known methods. One method includes a flash of light which conveys a reflection of the document to the charged surface through conventional stationary optics. Another method uses a light scanning system. Other methods may include laser scanning.

The copying process of a xerographic machine requires certain preparatory steps to achieve a copy ready state before the sequential copying steps can begin. These preparatory steps include preparing the photoconductive surface, charging the light source for generating the light image, moving the prepared photoconductive surface to the imaging station, and feeding a support material to the transfer station. The subsequent copying steps include creating the light image and transferring it to the prepared photoconductive surface, performing the subsequent developing step, transferring the developed image to the support material, and feeding the support material to the stacker.

A xerographic machine when not in use normally is in a standby condition. As used herein, the standby condition is a fully powered condition requiring only actuation of a start switch to begin the copying process. The standby condition, sometimes called a cycle out condition, is distinguished from a power saver mode available on some machines. On manual actuation of the start switch, the machine cycles to an operating condition and performs the preparatory steps and once the copy ready state is achieved the copying steps are immediately begun. The machine includes a timing circuit to control each subsequent series of copying steps in order to allow time for the preparatory steps. Once the copy ready state is achieved, the machine awaits a command before commencing the subsequent series of copying steps. A counter will issue an automatic command where multiple copies of an original have been selected. Where a plurality of original documents have been disposed in an automatic feeder, an automatic command is issued on placement by the feeder of each original in position for copying. Absent such an automatic command, a manual command generated by reactuation of the start switch is necessary to commence the copying steps. The machine includes a standby control which automatically cycles the machine to the standby condition if a predetermined time elapses without re-actuation of the start switch.

Efficient copying is difficult where a plurality of original documents are manually disposed for copying, a problem most often present when multiple pages of a bound book or document are to be copied. While reference to copying pages of a book or bound document is made throughout the specification, the invention is not so limited and may be used to copy various types of original documents. When the process of copying the first page of a book or document is complete that page must be turned so that the next can be manually disposed in position and the start switch depressed before the machine cycles to the standby condition. The next document or page must be in the proper position before the start switch is depressed since the machine will have achieved the copy ready state and on actuation of the start switch the copying steps will begin immediately. Since the delay before the machine cycles to the standby condition is relatively short, the machine frequently cycles to the standby condition before the next page can be disposed for copying. Subsequent actuation of the start switch will require the machine to cycle to the operating condition and achieve the copy ready state before copying of the next document can begin. To the operator this is a frustrating delay and to the machine this causes unnecessary operations resulting in undue wear on the components.

The invention provides an improved xerographic machine and related method for controlling the operation of sequential copying processes to permit manual disposition of subsequent documents or pages in position for copying without the machine cycling to the standby condition.

The invention provides for selective introduction of a delay, either fixed or variable, between achievement of the copy ready state and initiation of the copying steps.

Actuation of the start switch on a conventional xerographic machine generates a command for a single copying process. Thus, when copying pages of a book, the start switch must be depressed once for each page to be copied. The improved machine of the invention permits selective generation of two sequential copying processes, with a delay, either predetermined or selectively variable, between the two processes. This permits copying two adjacent pages of a book or other bound document before the machine cycles to the standby condition.

The invention alternatively provides for generation of a plurality of pairs of copying processes, the two processes of each pair being separated by a predetermined or selectively variable delay. When copying pages of a book, it frequently requires less time to position the immediately adjacent page for copying than is required to turn the page and position for copying. Thus, the invention provides for a different delay between pairs of processes, the different delay being longer to permit page turning and positioning for copying.

Additional advantages of the invention are set forth in part in the description which follows, and in part will be obvious from the description, or may be learned by practice of the invention.

SUMMARY OF THE INVENTION

The objects and advantages of the invention may be realized and attained by means of the instrumentalities and combinations particularly pointed out in the appended claims.

In a xerographic reproducing machine including a manually operable start switch, means responsive to actuation of the start switch for cycling from a standby condition to an operating condition for performing a process for copying a document, the copying process including machine preparation to a copy ready state and subsequent initiation of the sequential copying steps, a timing circuit for controlling initiation of the copying steps to permit achieving the copy ready state, and a standby circuit for cycling the machine to the standby condition after a predetermined time absent re-actuation of the start switch, the improvement comprises means connected to the timing circuit for delaying initiation of the copying steps after achieving the copy ready state, means for selectively activating and deactivating the delaying means, and means responsive to activation of the delaying means for bypassing the standby circuit.

The delaying means preferably comprises a timer which, when activated, interposes a delay between achieving the copy ready state and initiation of the copying steps, the timer interposing either a predetermined delay or being selectively variable.

In an alternative embodiment, the delaying means requires a command before initiating the copying steps and includes means for providing that command, such as a foot pedal.

Preferably, the machine includes means responsive to actuation of said delaying means for automatically generating two sequential processes for copying a document upon actuation of the start switch, the delaying means controlling initiation of the copying steps of the second sequential process.

BRIEF DESCRIPTION OF THE DRAWINGS

The accompanying drawings, which are incorporated in and constitute a part of the specification, illustrate embodiments of the invention, and, together with the description, serve to explain the principles of the invention.

DESCRIPTION OF THE PREFERRED EMBODIMENTS

Reference will now be made in detail to the present preferred embodiments of the invention, examples of which are illustrated in the accompanying drawings.

Figure 1:
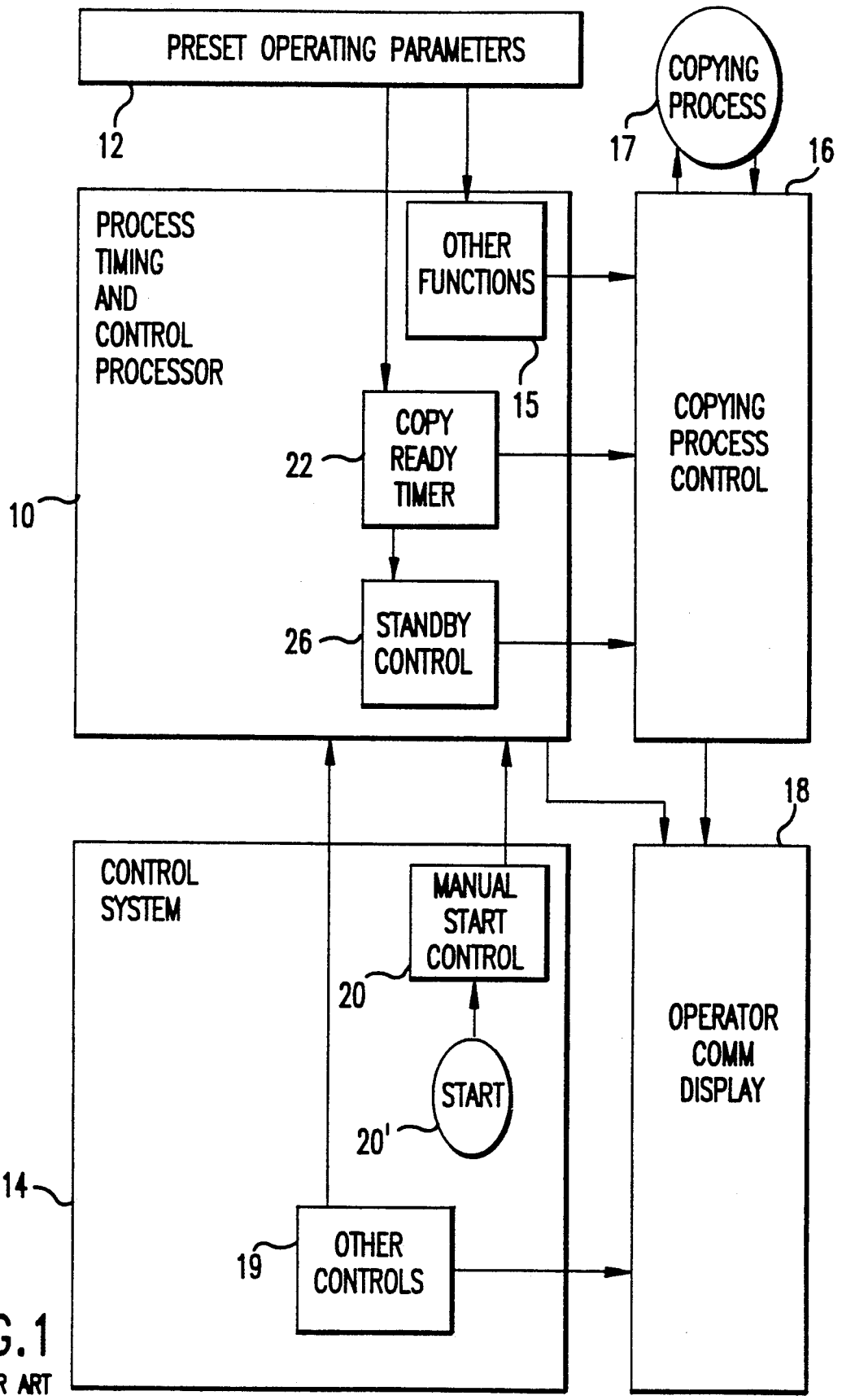
FIG. 1 PRIOR ART
FIG. 1 is a diagrammatic depiction of the operative elements of known xerographic reproducing machines.

The invention relates to an improvement of xerographic reproducing machines which permits control of the copying process so that sequential documents may be manually disposed for copying. Conventional xerographic reproducing machines, as diagrammatically depicted in FIG. 1, include a process timing and control processor 10 responsive to preset operating parameters in memory 12 and to selective operating parameters from control system 14. Processor 10 provides instructions to copying process control 16 which in turn controls copying process 17 of the machine. The machine also includes an operator communication display 18 to inform the machine operator of the status of various selected features, the machine status, errors, and other messages concerning the operation of the machine.

Control system 14 of conventional xerographic reproducing machines includes a manual start control 20 or start button, and a variety of other controls 19 for activating other functions 15 such as multiple copy selection, collating functions, magnification or reduction, continuous copying of a plurality of documents disposed in an automatic feed system, and a variety of other options. All functions of the machine initially require actuation of manual start switch 20.

Figure 2:
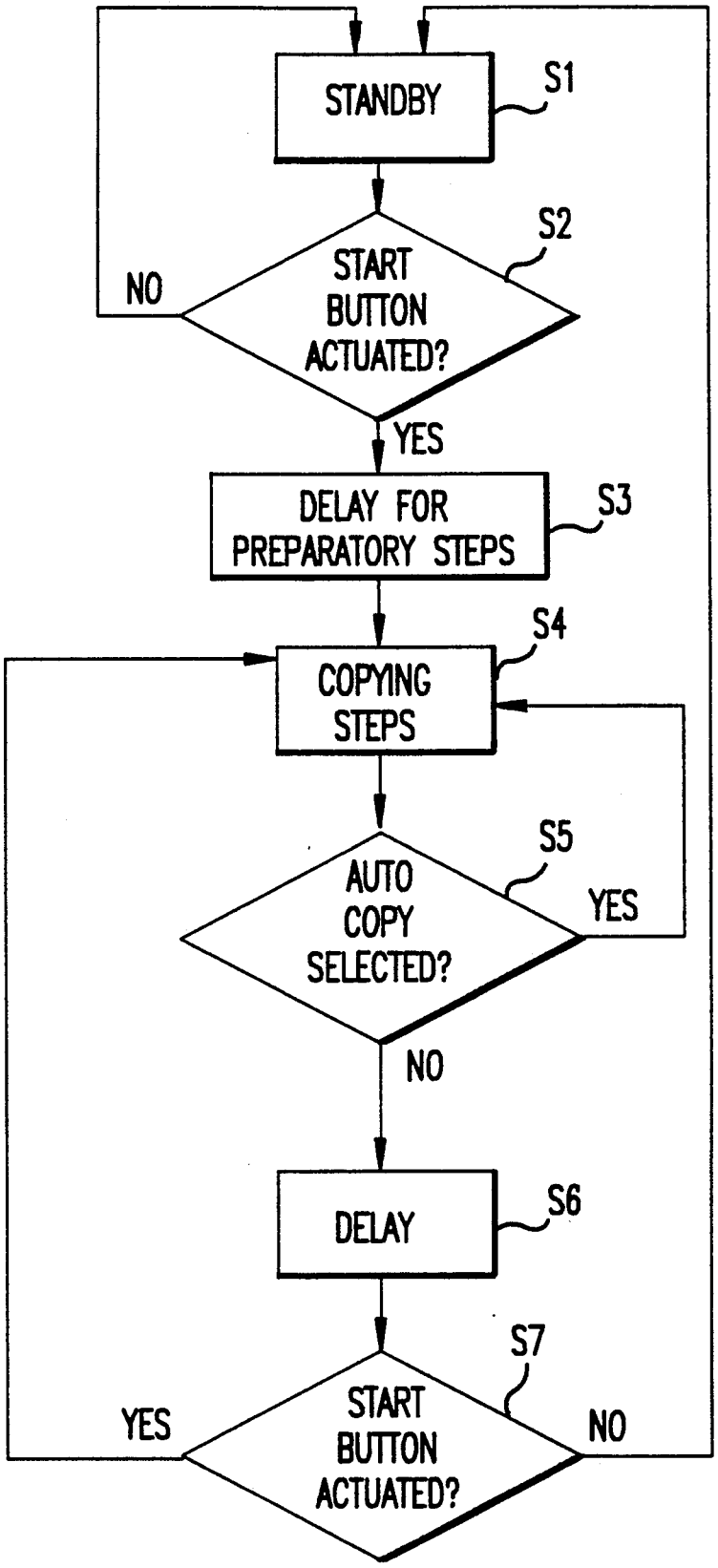
FIG.2 PRIOR ART
FIG. 2 is a flow chart depicting operation of known xerographic machines.

Conventional xerographic reproducing machines, when not in use, are in a standby condition S1. In this condition, the machine is warmed up and ready to operate, requiring only the actuation of manual start button 20' for the copying process to begin. In the conventional copying process, as depicted in FIG. 2, on the sensing of manual actuation of start button 20' in step S2, the machine cycles from the standby condition (step S1) and automatically performs the preparatory steps (step S3) as described in the background section of this specification, placing the machine in a copy ready state. A copy ready timer or timing circuit 22 automatically initiates the copying steps 24 (step S4) once the preparatory steps are complete.

In a conventional xerographic reproducing machine, on completion of the copying steps for making a single copy of an original document, the machine automatically achieves the copy ready state and awaits a command for performing a subsequent set of copying steps. That command may be automatically given (auto command 23) (step S5) if multiple copies have been selected in the control system or if continuous copying of a plurality of documents in an automatic feeder has been selected. Absent such automatic commands, the machine includes a standby control or standby circuit 26 incorporating a predetermined delay (step S6). When the predetermined delay elapses, the machine automatically cycles to standby condition at step S1 if an intervening actuation of the manual start switch 20' is not sensed at step S7. If the start switch is activated, the machine immediately performs the copying steps at step S4.

Figure 3:
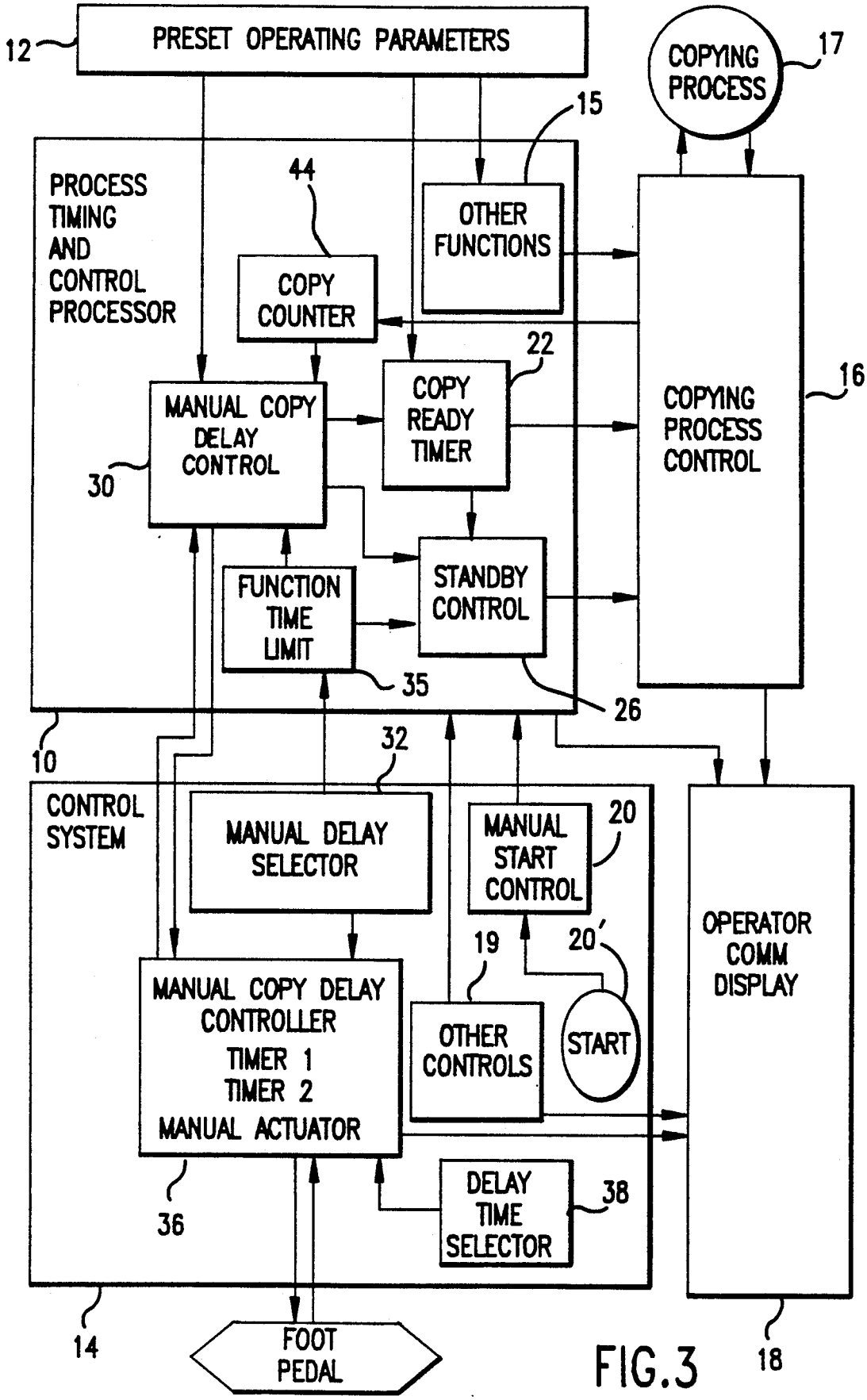
FIG. 3 is a diagrammatic depiction of the operative elements of a xerographic reproducing machine incorporating the invention.

The improved xerographic reproducing machine in accordance with the invention is depicted in FIG. 3 and comprises means connected to the copy ready timing circuit for delaying initiation of the copying steps after achieving the copy ready state. As embodied herein, the delaying means includes a manual copy delay control 30 in process timing and control processor 10. The delay control 30 is operatively connected to the copy ready timer 22, preferably includes a timer that when activated interposes a time delay between achieving the copy ready state and initiation of the copying steps. Design and construction of such a timer and its relationship to the copy ready timer for the stated functional purpose is well within the skill of the art.

The invention further comprises means for selectively activating the delaying means. As depicted in FIG. 3, control system 14 includes manual delay selector 32 operatively connected to manual copy delay control 30 for permitting the operator to set and activate the manual copy delay function.

The invention also comprises means responsive to activation of the delaying means for bypassing the standby circuit. As depicted in FIG. 3, the manual copy delay control 30 is operatively connected not only to copy ready timer 22, but also to standby control 26. This diagrammatically depicts the function of manual copy delay control 30, when activated, to disable or bypass the standby control 26 to preclude the machine from cycling to the standby condition.

Figure 4:
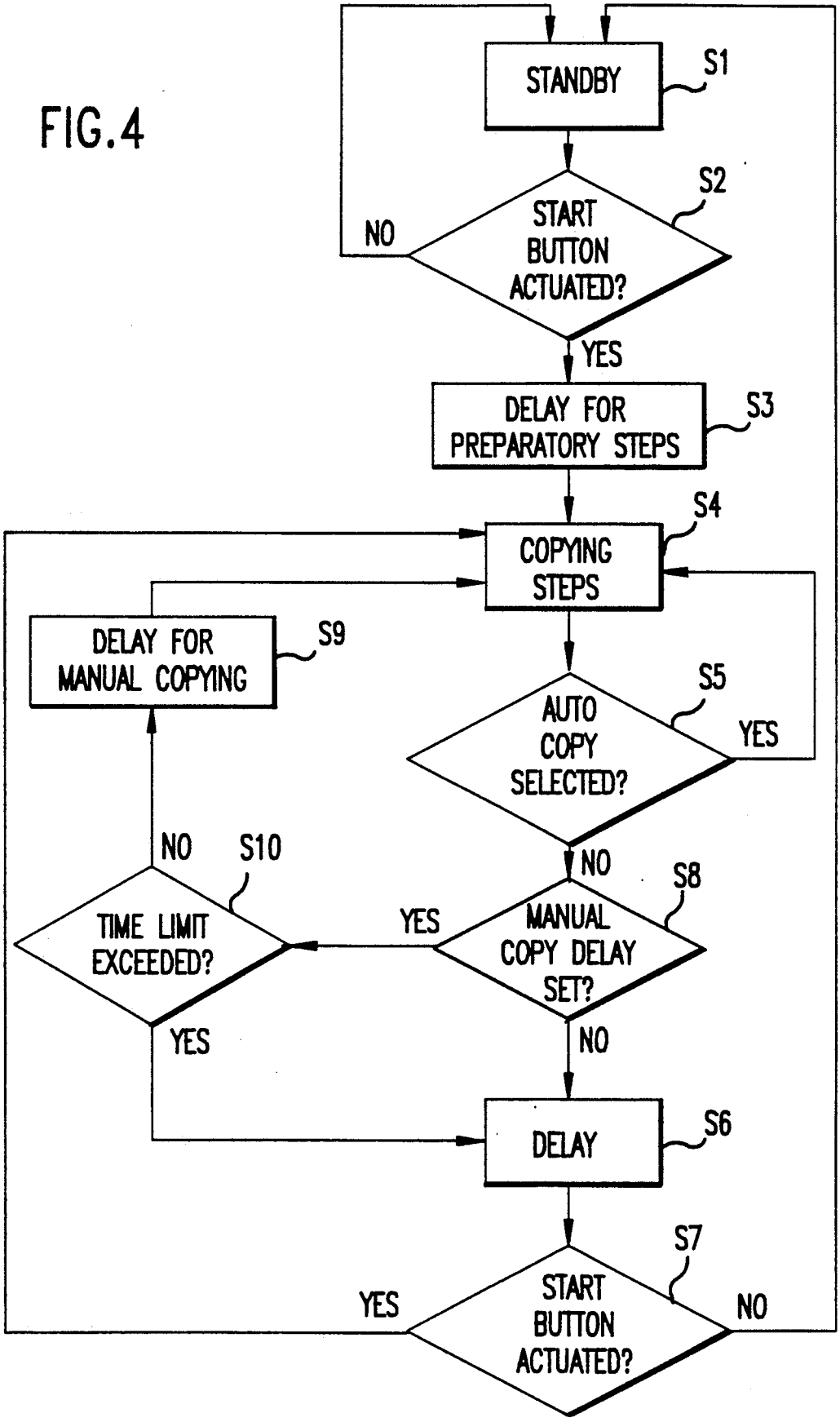
FIG. 4 is a flow chart depicting operation of a xerographic reproducing machine incorporating a first embodiment of the invention.

In one embodiment of the invention, manual copy delay control 30 includes a timer which, after a predetermined period of time, permits initiation of the copying steps of a subsequent copying process. Manual copy delay control 30 is depicted in FIG. 3 as receiving data from the preset operating parameter memory 12, which in this embodiment, would provide the predetermined delay period. Functionally, this embodiment, as depicted in FIG. 4, operates in a conventional manner through the first series of copying steps to generate an initial copy of an original document. Thereafter, if manual copy delay is determined to be selected at step S8, a delay step S9 provided by manual copy delay control 30 is interposed before performing the subsequent copying steps in step S4.

In this embodiment, so long as the manual copy delay has been selected, the copying steps will re-initiate automatically a predetermined period of time after achieving the copy ready state. Deactivating the manual copy delay would be required to cause the machine to resume normal operation, including cycling to the standby condition after a predetermined time absent re-actuation of the manual start button. Because an operator may inadvertently fail to deactivate the manual copy delay function, it may be desirable to automatically discontinue the manual copy delay function after a predetermined time (step S10), the time being sufficiently long to permit the manual copying of multiple originals but short enough to prevent unintentional continuous operation. As depicted in FIG. 3, The control system may include means for automatically discontinuing the manual copy delay function after a predetermined time. As embodied herein, the discontinuing means may comprise a function time limit selector 35 connected to the manual delay selector 32 and the manual copy delay control 30 may be included to return the machine to normal operation after a predetermined time of operation of the manual copy delay. In lieu of a time limit, automatic discontinuance of the manual copy delay function may be based upon a predetermined number of copies made as determined by a copy counter.

Preferably, the invention includes means connected to manual copy delay control 30 for selectively varying the effect of the control. As depicted in FIG. 3, manual copy delay controller 36 is included in control system 14 and is operatively connected to manual delay selector 32 and to manual copy delay control 30. Controller 36 may include one or more options for varying the effect of manual copy delay control 30.

In one embodiment, controller 36 includes means for selecting the duration of the delay for the preparatory steps (step S3), which delay is interposed between the copy ready state in step S1 and institution of the copying steps in step S4. As diagrammatically depicted in FIG. 3, delay time selector 38 is connected to the controller 36 to permit manual selection of the delay time period of delay timer 34.

In an alternative embodiment, the delaying means may be responsive to a command before initiation of the copying steps and means for selectively providing the command may be included. As depicted in FIG. 3, the command providing means may be embodied be a manual switch, or as depicted, a foot pedal 42 which allows the operator to selectively initiate subsequent copying steps after an original document has been manipulated into a position for copying.

As depicted in FIG. 3, controller 36 may include both options of a delay time selector 32 and a foot pedal command 42, allowing the operator to vary delay time of timer 34 or, alternatively, initiate the copying steps.

Figure 5:
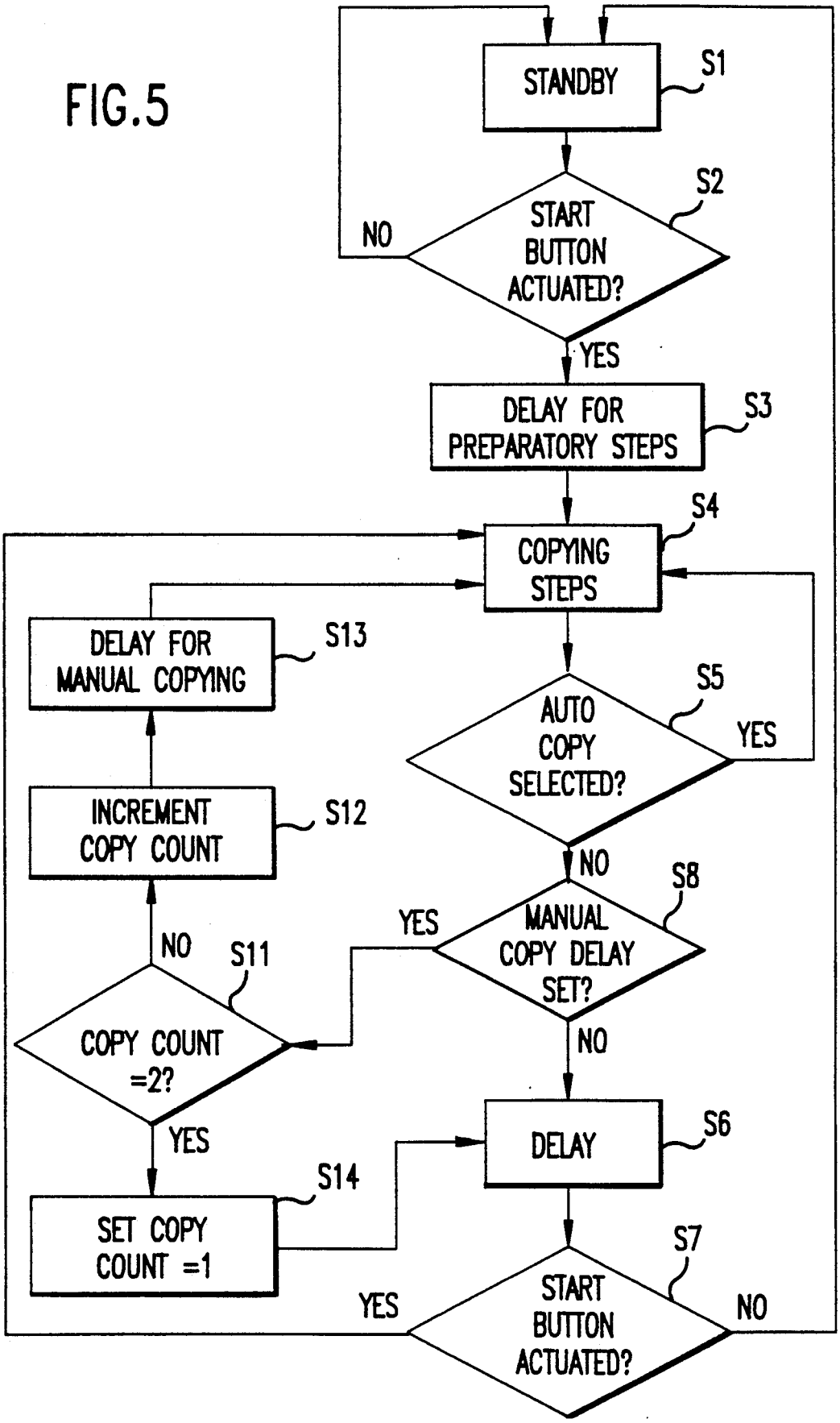
FIG. 5 is a flow chart depicting operation of a xerographic reproducing machine incorporating a second embodiment of the invention.

As already noted, in conventional xerographic reproducing machines, absent use of an automatic feeder or selection of multiple copies of one original document, the machine will automatically cycle to the standby condition after making a single copy. In an alternative preferred embodiment, means are provided for automatically generating two sequential copies with an appropriate delay between the sequential series of copying steps. In this embodiment, as depicted in FIG. 5, in lieu of the function time limit 35 in FIGS. 3 and 4, a copy counter 44 (FIG. 3) determines when the machine reverts to normal operation. After a copy of the first manually disposed original is made, counter 44, based on feedback from the copying process control 16, determines whether to revert to normal operation, e.g., delay (step S6) and standby (step S1), or to initiate a second series of copying steps (step S4), after the delay of timer 34, to make a copy of a second manually disposed original before returning to the standby mode. After two copies have been made, the machine cycles to standby (step S1) absent actuation of the start switch 20'.

Figure 6:
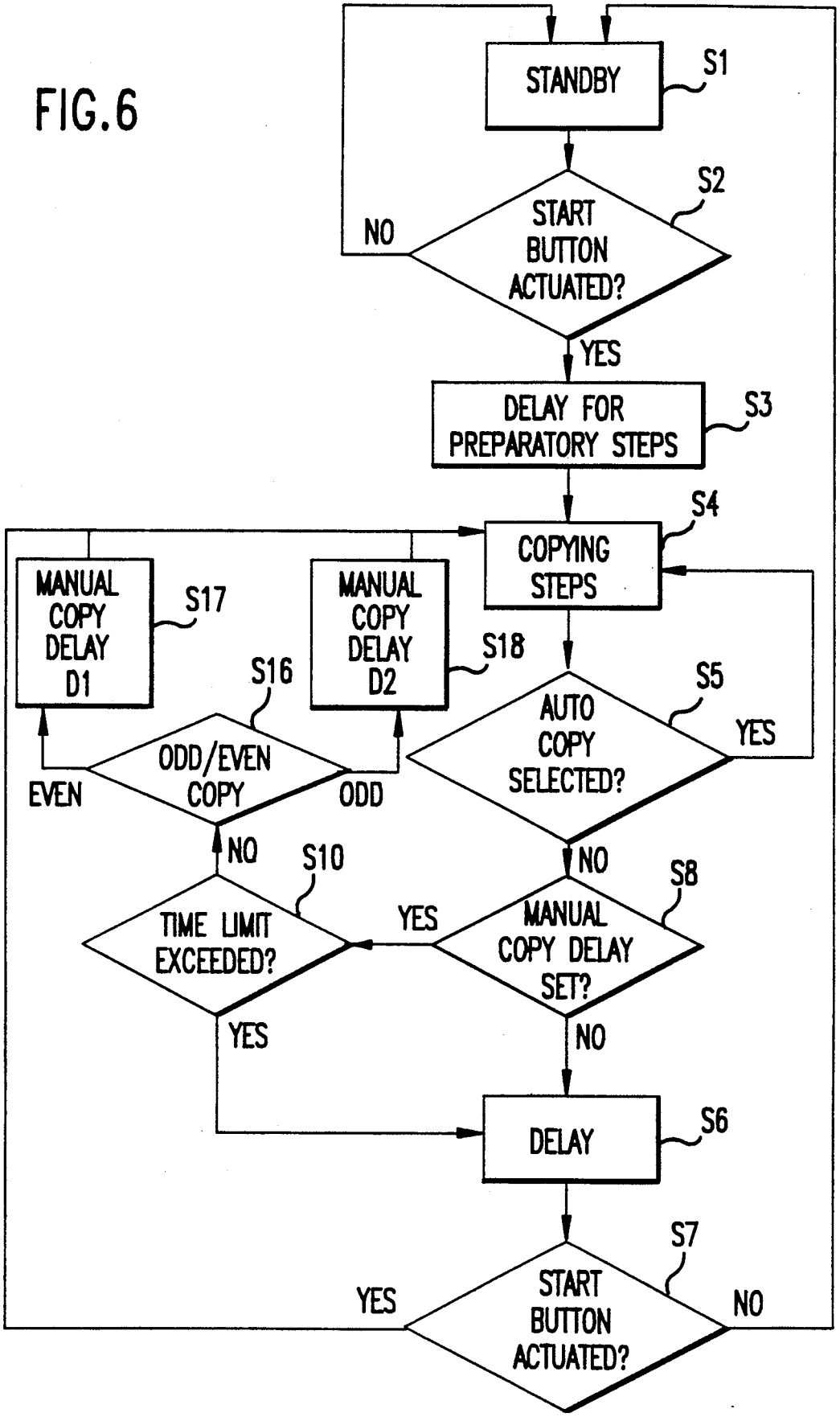
FIG. 6 is a flow chart depicting operation of a xerographic reproducing machine incorporating a third embodiment of invention.
Figure 7:
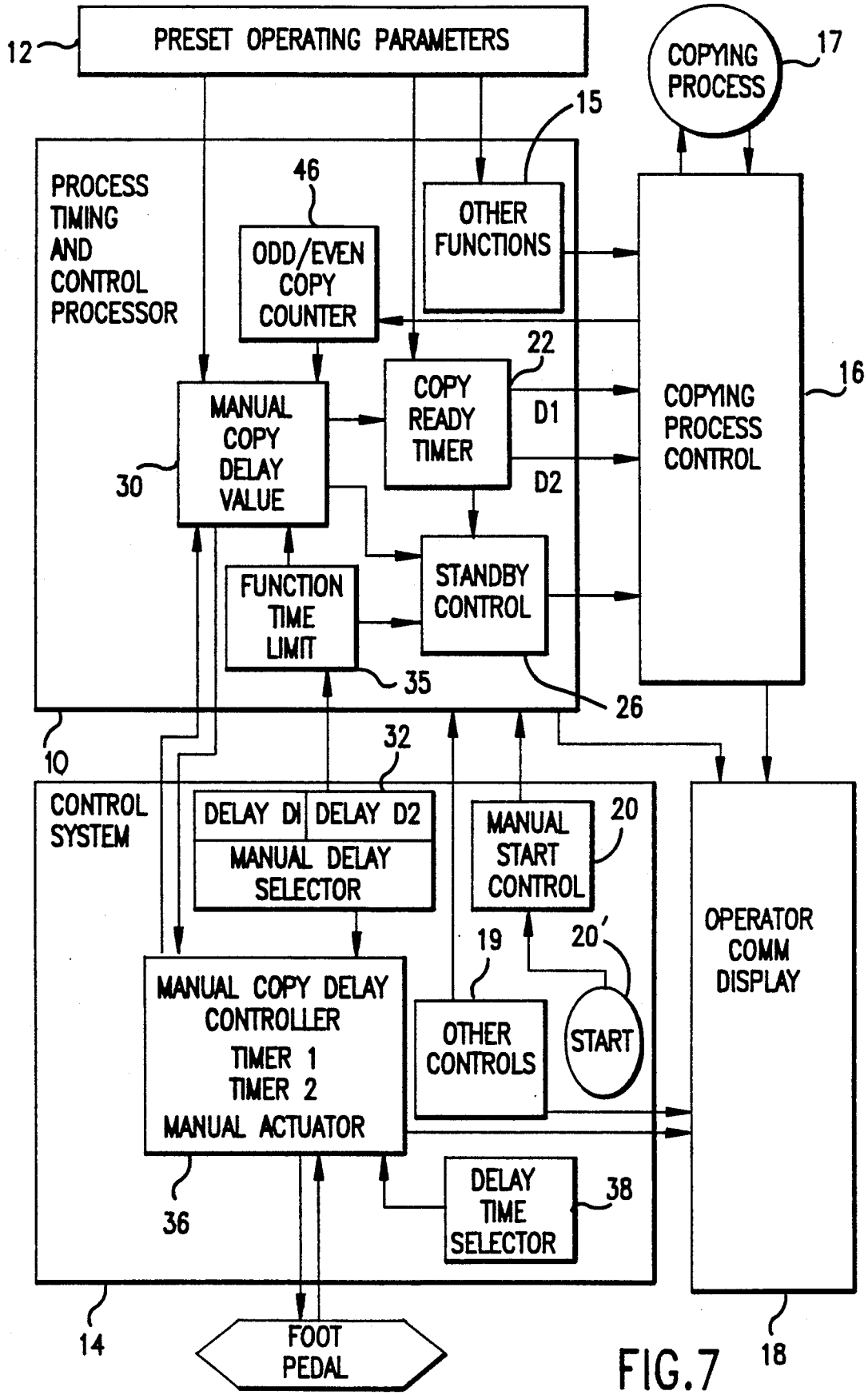
FIG. 7 is a diagrammatic depiction of a xerographic reproducing machine incorporating the third embodiment of the invention.

Because the delay S6 in the embodiment of FIG. 5 may be insufficient to permit 1) turning pages to the next pair of pages in a book being copied, 2) manually disposing on the platen for copying the first of the next pair of pages, and 3) actuating the start switch, the machine will cycle to the standby stat (step S1) requiring re-initiation of the copying process. The embodiment depicted in FIG. 6 provides means for copying a plurality of sequential pairs of original documents or pages without cycling to the standby state (step S1). In this embodiment as shown in FIG. 7, an odd/even copy counter 46 is connected to the manual copy delay control 30 and the copying process control 16 to provide a signal to the manual copy delay control to indicate whether an even page or an odd page is being copied. The manual delay selector makes the setting of delay D1 for even pages and delay D2 for odd pages in accordance with the output of the odd/even copy counter 46. The manual copy delay control 30 controls the copy ready time 22 to delay a period D1 when an even page is to be copied and a period D2 when an odd page is to be copied. The use of the terms odd and even for pages being copied is not intended to be limiting; the terms are used only as convenient references for adjacent pages of a book or document. The first page copied, regardless of whether numbered odd or even in the bound document, is considered even for purposes of this description since normally the left or even page of a book is copied first.

As shown in FIG. 6, after a copy of the first original is made (normally an even page in a book), odd/even counter 46, based on feedback from the copy process control 16, provides an input to the manual copy delay control 30 to cause a first delay D1 (step S17) before initiating copying steps for the next copy (an odd page). Thereafter, odd/even counter 46 alternates to produce delays D1 and D2. Since the time for manually disposing immediately adjacent pages of a book for copying is less than for turning the pages and manual disposing the first of the next pair of pages for copying, the first delay D1 may be set to be a shorter time than the second delay D2. The times of delays D1 and D2 may be set for predetermined time periods or may be selectively set by the manual delay selector 32. Alteratively, a computer controller may "learn" the actual time required for delays D1 and D2 from manual operation over two or three cycles; the times D1 and D2 thereafter could be set automatically or displayed for manual setting. This embodiment, of course, may not be necessary where the manual command function depicted in FIG. 4 is selected.

Figure 8A:
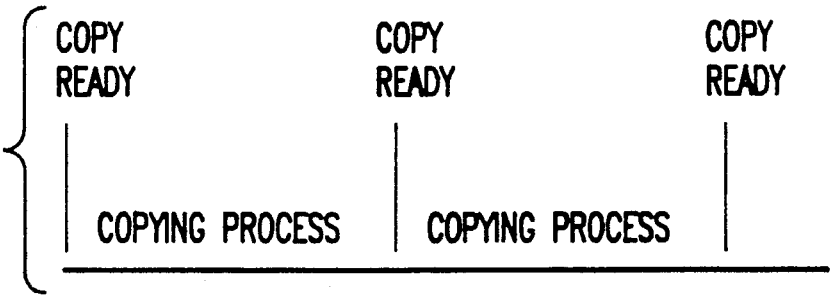
FIGS. 8A-8D are timing diagrams of known xerographic reproducing processes and the timing of the process according to the present invention.
Figure 8B:
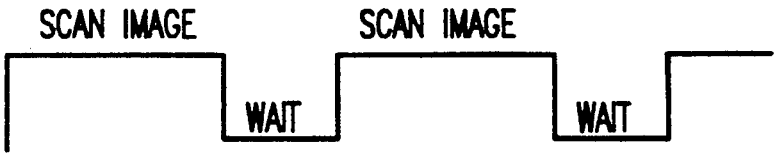
Figure 8C:
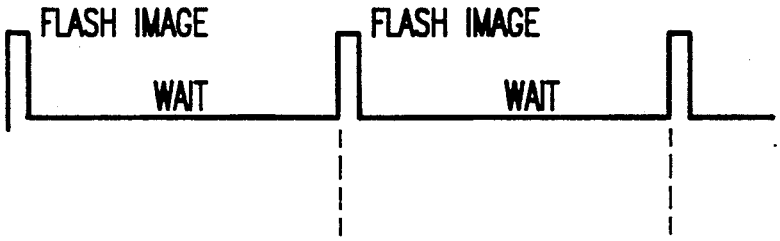
Figure 8D:
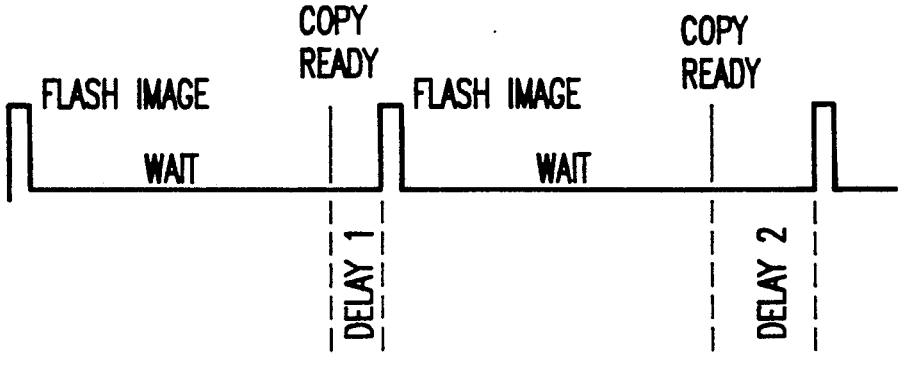

As previously described, the copying process includes the completion of certain machine preparatory steps and the performance of the copying steps. On completion of the preparatory steps the machine is copy ready. This basic function is graphically depicted in FIG. 8A. FIGS. 8B and 8C graphically depict the copying process for two types of xerographic reproducing machines. In a scanning machine (FIG. 8B), the imaging process is continuous and coextensive with the other copying steps, while in a flash machine (FIG. 8C) a single flash reflects an image of an entire original onto a prepared photoconductive surface. In each machine there is a wait period after imaging for completing the copying steps and the preparatory steps for the next copy ready state. In both machines, the invention interposes a delay between the copy ready state and the beginning of the next imaging process. FIG. 8D graphically depicts the effect of the embodiment of FIG. 7 on the operation of a flash imaging machine by establishing first delay D1 and second delay D2. Of course, delays D1 and D2 would be the same in, for example, the embodiment of FIG. 4 and would be infinitely variable in the embodiment of FIG. 5.

The length of any predetermined or variable delay will depend upon the type of xerographic reproducing machine incorporating the invention. Some machines have seamless photoreceptors permitting continuous timing of images; in these machines the delay may be adjusted continuously to a fraction of a second as determined by the resolution of a machine clock. In other machines, the photoreceptor has a seam requiring images to be placed in discrete locations on the photoreceptor. Delay timing on the latter machines must be multiples of the normal imaging rate. Large machines having multiple imaging areas on the photoreceptor will allow continuous adjustment of the delay time so long as no image falls on the seam.

In accordance with the invention, a method of xerographically reproducing each of a plurality of documents sequentially, manually disposed for copying in a machine which performs a copying process on manual activation and thereafter cycles to a standby condition absent manual reactivation during a predetermined time after conclusion of the copying process, comprises the steps of causing the machine on manual activation to generate a plurality of sequential copying processes without cycling to the standby condition, disposing for copying the first of the plurality of documents, manually activating the machine to initiate the first of the sequential copying processes, and controlling initiation of each subsequent sequential copying process to permit time for subsequent manual disposition for copying of each of the remaining plurality of documents.

Actuation of manual delay selector 34 causes the machine, on manual actuation, to generate a plurality of sequential copying processes without cycling to the standby state. In the embodiments of FIGS. 3, 4 and 7, the number of sequential copying processes are limited only by the function time limit 35. In FIG. 5 two sequential copying processes occur without cycling to standby state S1. The sequential copying processes commence after manual disposition for copying of the first of the plurality of documents and actuation of start switch 20'. Subsequent sequential copying processes are controlled by function time limit 35 or copy counter 44 and delay timer 34, delay switch 40 or first and second time delays D1 and D2.

The actual design and construction of the controlling circuits and switches necessary for the invention are well within the skill of the art. It also will be apparent to those skilled in the art that various modifications and variations could be made to the invention without departing from the scope or spirit of the invention.

What is claimed is:

1. In a xerographic reproducing machine including a manually operable start switch, means responsive to actuation of the start switch for cycling from a standby condition to an operating condition for performing a process for copying a document, the copying process including machine preparation to a copy ready state and subsequent initiation of the sequential copying steps, a timing circuit for initiating the copying steps after achieving the copy ready state, and a standby circuit for cycling the machine to the standby condition after a predetermined time absent re-actuation of the start switch, the improvement comprising:

means connected to said timing circuit for delaying initiation of the copying steps after achieving the copy ready state;

means for selectively activating said delaying means; and means responsive to activation of the delaying means for bypassing the standby circuit.

2. The machine of claim 1, wherein said delaying means comprises a timer which when activated interposes a predetermined time between achieving the copy ready state and initiation of the copying steps.

3. The machine of claim 1, wherein said delaying means comprises a timer which when activated interposes a time period between achieving the copy ready state and initiation of the copying steps and means connected to said timer for selectively varying said time period.

4. The machine of claim 1, wherein said delaying means initiates the copying steps in response to a command and the machine further includes means for selectively providing said command.

5. The machine of claim 4, wherein said providing means is a manually operable switch.

6. The machine of claim 5, wherein said manually operable switch includes a foot pedal for manual actuation.

7. The machine of claim 1, further including means responsive to actuation of said delaying means for automatically generating two sequential processes for copying a document upon actuation of said start switch, said delaying means controlling initiation of the copying steps of the second sequential process.

8. The machine of claim 7, wherein said delaying means comprises a timer which when activated interposes a predetermined time between achieving the copy ready state and commencement of the copying steps in said second process.

9. The machine of claim 8, wherein said delaying means comprises a timer which when activated interposes a time period between achieving the copy ready state and commencement of the copying steps in said second process and means connected to said timer for selectively varying said time period.

10. In a xerographic reproducing machine which on manual activation cycles from a standby condition to an operating condition in which a copying process generates a copy of a document disposed for copying, and wherein the machine, absent additional manual activation, cycles to the standby condition after completion of the copying process, the improvement comprising:

means responsive to said manual activation for causing two sequential coping processes before said machine cycles to said standby condition to permit generation of a copy of two documents successively disposed for copying;

means for selectively activating said causing means; and means for controlling the time between said copying processes to permit manual disposition and generation of a copy of the second of said two documents before said machine cycles to said stanby condition.

11. The machine of claim 10, wherein said controlling means comprises a first timer which determines the time between said two sequential copying processes.

12. The machine of claim 11 wherein said first timer is adjustable to permit selective variation of the time between said two sequential copying processes.

13. The machine of claim 10 wherein said controlling means comprises a manually operable switch activation of which permits the second of said two sequential copying processes.

14. The machine of claim 13, wherein said manually operable switch is activated by a foot pedal.

15. The machine of claim 10, further including means responsive to activation of the causing means for preventing the machine from cycling to the standby condition after completion of the second of said two sequential copying processes and means for generating sequential pairs of said two sequential copying processes.

16. The machine of claim 15, wherein said controlling means includes a first timer for determining the time between the two sequential copying processes of each pair and a second timer for determining the time between sequential pairs of said two sequential copying processes.

17. The machine of claim 16, wherein said first and second timers are each selectively variable.

18. The machine of claim 15, wherein said controlling means includes a first timer for determining the time between the two sequential copying processes of each pair and a manually actuable switch determining the time between sequential pairs of said two sequential copying processes.

19. A method of xerographically reproducing each of a plurality of documents sequentially, manually disposed for copying in a machine which performs a copying process on manual activation and thereafter cycles to a standby condition absent manual reactivation during a predetermined time after conclusion of the copying process, the method comprising the steps of:

causing the machine on manual activation to generate a plurality of sequential copying processes without cycling to the standby condition;

disposing for copying the first of said plurality of documents;

manually activating the machine to initiate the first of said sequential coping processes; and controlling initiation of each subsequent sequential copying process to permit time for subsequent manual disposition for copying of each of the remaining plurality of documents.

20. The method of claim 19, wherein said controlling step includes automatically initiating each subsequent sequential copying process after a pre-selected time.

21. The method of claim 20, wherein said controlling step includes manually initiating each subsequent sequential copying process.

22. The method of claim 21, wherein said manual initiation is achieved by a foot pedal.

* * * * *